US007786956B2

(12) United States Patent
Tsujita et al.

(10) Patent No.: US 7,786,956 B2
(45) Date of Patent: Aug. 31, 2010

(54) PLASMA DISPLAY DEVICE

(75) Inventors: Yoshiki Tsujita, Osaka (JP); Kenji Ogawa, Osaka (JP); Kenji Sasaki, Osaka (JP); Toru Ando, Osaka (JP); Tohru Sakane, Osaka (JP)

(73) Assignee: Panasonic Corporation, Osaka (JP)

( * ) Notice: Subject to any disclaimer, the term of this patent is extended or adjusted under 35 U.S.C. 154(b) by 446 days.

(21) Appl. No.: 11/721,609

(22) PCT Filed: Mar. 13, 2006

(86) PCT No.: PCT/JP2006/304879

§ 371 (c)(1),
(2), (4) Date: Jun. 13, 2007

(87) PCT Pub. No.: WO2006/098262

PCT Pub. Date: Sep. 21, 2006

(65) Prior Publication Data

US 2009/0278821 A1 Nov. 12, 2009

(30) Foreign Application Priority Data

Mar. 14, 2005 (JP) ..... 2005-070706

(51) Int. Cl.
*G09G 3/28* (2006.01)

(52) U.S. Cl. ..... 345/63; 345/60; 315/169.4

(58) Field of Classification Search ..... None
See application file for complete search history.

(56) References Cited

U.S. PATENT DOCUMENTS 4,147,960 A * 4/1979 Andoh et al. ..... 345/62
5,717,437 A 2/1998 Sano et al.
5,854,540 A * 12/1998 Matsumoto et al. ..... 315/169.1
5,943,030 A 8/1999 Minamibayashi
5,990,630 A * 11/1999 Nakamura ..... 315/169.4
6,281,635 B1 * 8/2001 Lee ..... 315/169.4
6,529,177 B2 3/2003 Nakamura (Continued)

FOREIGN PATENT DOCUMENTS

JP 8-160901 A 6/1996

(Continued)

OTHER PUBLICATIONS

Japanese Office Action for 2005-070706, Dec. 22, 2009.

(Continued)

*Primary Examiner*—Alexander Eisen
*Assistant Examiner*—Matthew Yeung
(74) *Attorney, Agent, or Firm*—RatnerPrestia

(57) ABSTRACT

A plasma display device includes an AD converter; a video signal processing circuit producing subfield data; a subfield processing circuit producing control signals of each of drive circuits; a plasma display panel having scan electrodes and sustain electrodes which are alternately arranged in n rows, and data electrodes in (k+m) columns arranged in a direction of intersecting with the scan and sustain electrodes; a scan-electrode drive circuit for driving scan electrodes; a sustain-electrode drive circuit for driving sustain electrodes; and a data-electrode drive circuit which has a first drive circuit for driving data electrodes and a second drive circuit for driving data electrodes, and applies writing pulse voltage in order from a data electrode group nearest to the scan-electrode drive circuit.

4 Claims, 5 Drawing Sheets

U.S. PATENT DOCUMENTS

| | | | | |
|---|---|---|---|---|
| 6,756,977 | B2 * | 6/2004 | Ide | 345/212 |
| 2004/0257306 | A1 * | 12/2004 | Choi | 345/60 |

FOREIGN PATENT DOCUMENTS

| | | | |
|---|---|---|---|
| JP | 8-305319 | A | 11/1996 |
| JP | 9-146490 | A | 6/1997 |
| JP | 10-198304 | A | 7/1998 |
| JP | 2000-181405 | A | 6/2000 |
| JP | 2000-276107 | A | 10/2000 |
| JP | 2000-338930 | A | 12/2000 |
| JP | 2001-272948 | A | 10/2001 |
| JP | 2004-212699 | A | 7/2004 |

OTHER PUBLICATIONS

Japanese language International Search Report for PCT/JP2006/304879, dated May 30, 2006.

* cited by examiner

PLASMA DISPLAY DEVICE

This application is a U.S. National Phase Application of PCT International Application PCT/JP2006/304879.

TECHNICAL FIELD

The present invention relates to a plasma display device used for a wall-hanging television or a large monitor.

BACKGROUND ART

An AC surface-discharge plasma display panel (hereinafter, abbreviated as "panel") as a typical AC type plasma display panel is configured by a front panel including a glass substrate on which scan electrodes and sustain electrodes between which surface discharge occurs are formed in lines, and a back panel including a glass substrate on which data electrodes are formed in lines. The front panel and the back panel are disposed parallel and oppositely to each other such that the electrodes on both panels are in a matrix form, in addition, discharge spaces are formed in a gap between them, and sealed at their outer circumferential portions with a sealing material such as glass frit. Between the front panel and the back panel, discharge cells are provided, the cells being divided by barrier ribs formed on the back panel. Phosphor layers are formed on inner wall surfaces of cell spaces divided by the barrier ribs. In the panel having such a configuration, ultra-violet rays are generated by gas discharge, and the ultraviolet rays excite the phosphor layers of respective colors of red (R), green (G), and blue (B) to emit visible light for color display.

In the panel, one field period is divided into a plurality of subfields, and subfields for emission are selected and combined to drive the panel for gray-scale display. Each subfield includes an initialization period, a writing period, and a sustaining period. To display image data, different signal waveforms are applied to the respective electrodes in the initialization period, writing period, and sustaining period respectively.

In the initialization period, for example, positive pulse voltage are applied to all the scan electrodes, so that necessary wall charge is accumulated on a protective layer on a dielectric layer covering the scan electrodes and the sustain electrodes and on the phosphor layers. In addition, priming particles (priming for discharge, that is, excitation particles) are generated in the period, the particles being for reducing delay in discharge to stably induce writing discharge.

In the writing period, negative scan pulses are sequentially applied to all the scan electrodes for scanning the electrodes. While scanning the scan electrodes, positive writing pulse voltage is applied to data electrodes corresponding to discharge cells to be displayed according to display data. Writing discharge is induced between the data electrodes applied with the positive writing pulse voltage and the scan electrodes, and writing wall charge is thus formed on a surface of the protective layer on the scan electrodes. At that time, since the writing voltage is applied to all the data electrodes configuring display cells, in which the writing discharge is to be induced, at the same time, on one scan electrode, all the writing discharge to be induced is induced at a time, causing flow of discharge current. Therefore, voltage drop due to impedance of the scan electrodes and a drive circuit becomes large. As a result, there is a difficulty that stable writing discharge is hard.

In the next sustaining period, a voltage pulse sufficient to keep the discharge is applied between the scan electrodes and the sustain electrodes. This induces sustaining discharge in the discharge cells having the writing wall charge formed therein. Then, discharge plasma is generated between the scan electrodes and the sustain electrodes, and the phosphor layers are excited and thus emit light for a certain period by ultraviolet rays caused by the discharge plasma. At that time, in discharge cells that were not applied with the writing pulse voltage during writing, discharge is not induced and the phosphor layers are not excited and thus do not emit light.

In such a panel, there is a difficulty that large delay in discharge occurs in writing discharge in a subsequent writing period in the subfields, consequently writing operation becomes unstable.

To overcome the difficulties, a technique has been proposed, in which the data electrodes are divided into at least two data electrode groups, and timing of applying the writing voltage to the data electrodes in the writing period is varied by setting time difference between the data electrode groups. As such a technique in the related art, a technique in Japanese Patent Unexamined Publication No. 8-305319 is known.

In the technique, the data electrodes are divided into two data electrode groups, and time difference is set in timing of applying writing pulse voltage to respective data electrode groups in a writing period, so that time difference exists in timing of starting writing discharge corresponding to respective data electrode groups. In this way, discharge current flowing into the scan electrodes in writing discharge is temporarily dispersed. As a result, compared with a case that all writing discharge is induced at a time on one scan electrode, a peak value of the discharge current flowing into the scan electrode can be controlled low. Therefore, voltage drop can be controlled to stabilize applied voltage to respective discharge cells, consequently stable discharge can be realized, the voltage drop being caused by impedance in a circuit of driving the scan electrodes or metal wires forming the scan electrodes.

However, in the related art as described above, the writing discharge must be induced in a surely separated manner to sufficiently reduce the peak value of the discharge current. To this end, sufficient time difference must be set in timing of applying writing pulse voltage to the data electrode groups respectively. As a result, there is a difficulty that writing time is set long, resulting in increase in time taken for the writing period.

Particularly, in a panel having increased resolution, time to be set for the writing period is increased with increase in number of scan electrodes. As a result, time to be set for the sustaining period needs to be decreased, consequently a difficulty of decrease in peak luminance arises. Therefore, in such a panel, a subject is given, that is, the writing time needs to be reduced to the utmost so that time for the sustaining period is secured.

DISCLOSURE OF THE INVENTION

A plasma display device of the invention includes a plasma display panel having a plurality of scan electrodes and sustain electrodes, which are disposed parallel to each other on a front panel and configure display electrode pairs, and are electrically connected to a plurality of scan-electrode lead lines and sustain-electrode lead lines for applying drive voltage at one ends respectively, and having a plurality of data electrodes that are disposed in a direction intersecting with the scan electrodes on a back panel disposed oppositely to the front panel with discharge spaces between them, and configure display cells with the display electrode pairs; a scan-electrode drive circuit connected to the scan-electrode lead lines for driving the scan electrodes; a sustain-electrode drive circuit connected to the sustain-electrode lead lines for driving the sustain electrodes; and a data-electrode drive circuit that divides the data electrodes into a plurality of data electrode groups and drives the groups respectively; wherein the scan-electrode drive circuit, sustain-electrode drive circuit, and data-electrode drive circuit apply different driving waveforms to each of the scan electrodes, sustain electrodes, and data electrodes in each of a writing period and the sustaining period to drive the electrodes, the two periods configuring the subfield, and the data-electrode drive circuit applies writing pulse voltage to each of the data electrode groups in order from a data electrode group nearest to the scan-electrode lead lines in the writing period.

Moreover a plasma display device of the invention includes a plasma display panel having a plurality of scan electrodes and sustain electrodes that are disposed parallel to each other on a front panel and configure display electrode pairs, and a plurality of data electrodes that are disposed in a direction intersecting with the scan electrodes on a back panel disposed oppositely to the front panel with discharge spaces between them, and configure display cells with the display electrode pairs; a scan-electrode drive circuit that is disposed close to one side among two sides parallel to the data electrodes in four sides of the plasma display panel, and drives the scan electrodes; a sustain-electrode drive circuit that is disposed close to the other side among the two sides parallel to the data electrodes in the four sides of the plasma display panel, and drives the sustain electrodes; and a data-electrode drive circuit that is disposed close to one side among two sides parallel to the scan electrodes and the sustain electrodes in the four sides of the plasma display panel, and divides the data electrodes into a plurality of data electrode groups and drives the groups respectively; wherein the scan-electrode drive circuit, sustain-electrode drive circuit, and data-electrode drive circuit apply different driving waveforms to each of the scan electrodes, sustain electrodes, and data electrodes in each of the writing period and the sustaining period to drive the electrodes, the two periods configuring a subfield, and the data-electrode drive circuit applies writing pulse voltage to each of the data electrode groups in order from a data electrode group nearest to the scan-electrode lead lines in the writing period.

BRIEF DESCRIPTION OF REFERENCE NUMERALS AND SIGNS

Figure 1:
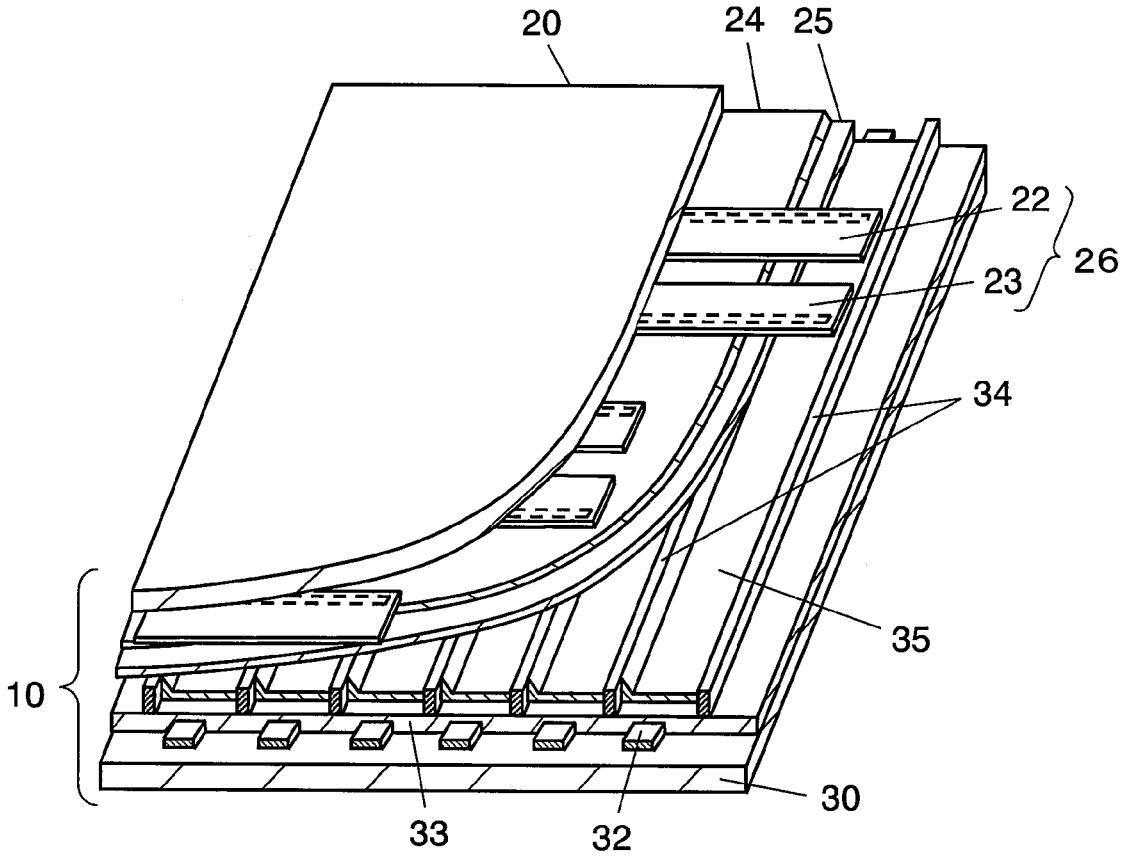
FIG. 1 is an exploded perspective view showing a structure of a plasma display panel of a plasma display device of an embodiment 1 of the invention.

1 AD converter
2 video signal processing circuit
3 subfield processing circuit
4 data-electrode drive circuit
5 scan-electrode drive circuit
6 sustain-electrode drive circuit
10 plasma display panel
20 (glass) front panel
22 scan electrode
23 sustain electrode
24, 33 dielectric layer
25 protective layer
26 display electrode pair
30 back panel
32 data electrode
34 barrier rib
35 phosphor layer

BEST MODE FOR CARRYING OUT THE INVENTION

Embodiment 1

FIG. 1 shows an exploded perspective view showing a structure of plasma display panel (hereinafter, abbreviated as "panel") 10 of a plasma display device of an embodiment 1 of the invention. The panel is configured by front panel 20 and back panel 30. On glass front panel 20 in a view from a side of front panel 20, a plurality of display electrode pairs 26 including stripe scan electrodes 22 and stripe sustain electrodes 23 forming the pairs are formed. Dielectric layer 24 is formed in a way of covering display electrode pairs 26, and protective layer 25 is formed on dielectric layer 24.

On back panel 30, a plurality of stripe data electrodes 32 are formed in a two-level crossing manner with display electrode pairs 26, and data electrodes 32 are covered with dielectric layer 33. On dielectric layer 33, a plurality of stripe barrier ribs 34 are disposed parallel to data electrodes 32, and phosphor layers 35 are provided on dielectric layer 33 between barrier ribs 34. Data electrodes 32 are disposed in positions between barrier ribs 34 adjacent to one another. A shape of barrier ribs 34 is not limited to the stripe form, and may be a lattice form or a box-like form.

Front panel 20 and back panel 30 are oppositely disposed with barrier ribs 34 between them such that display electrode pairs 26 are perpendicular to data electrodes 32, and sealed by a sealing material such as glass frit at outer circumferential portions of front panel 20 and back panel 30. Between front panel 20 and back panel 30, small discharge spaces divided by barrier ribs 34 are formed. In the discharge spaces, for example, a mixed gas of neon (Ne) and xenon (Xe) is enclosed as discharge gas. The discharge spaces are divided into a plurality of regions by barrier ribs 34, and phosphor layers 35 emitting light of respective colors of red (R), green (G), and blue (B) are sequentially disposed on wall surfaces of barrier ribs 34 and a top of dielectric layer 33 in each region. Discharge cells are formed in regions where display electrode pairs 26 are intersected with data electrodes 32. A pixel is configured by adjacent three discharge cells in which phosphor layers 35 emitting light of respective colors are formed respectively. An area of the panel in which the discharge cells configuring the pixels are formed corresponds to an image display area, and the periphery of the image display area is a non-display area where image display is not performed such as an area of the glass frit sealing.

Figure 2:
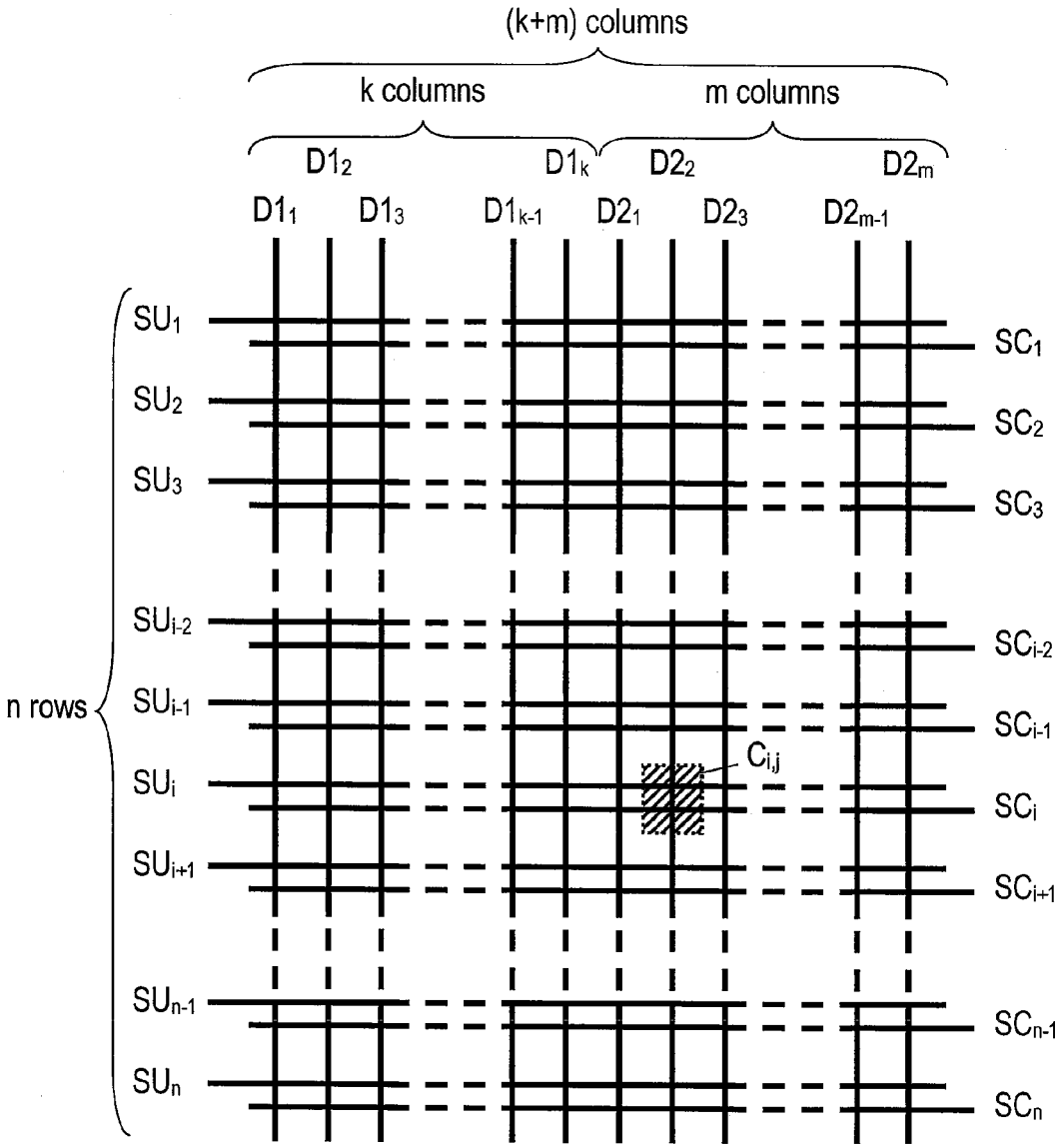
FIG. 2 is an electrode arrangement diagram of the plasma display panel of the plasma display device of the embodiment 1 of the invention.

FIG. 2 shows an electrode arrangement diagram of panel 10 of the plasma display device of the embodiment 1 of the invention. Scan electrodes $SC_1$ to $SC_n$ (scan electrodes 22 in FIG. 1) in n rows and sustain electrodes $SU_1$ to $SU_n$ (sustain electrodes 23 in FIG. 1) inn rows, extending in a row direction, are alternately arranged. Data electrodes $D1_1$ to $D1_k$ and $D2_1$ to $D2_m$ (data electrodes 32 in FIG. 1) in (k+m) columns extending in a column direction are arranged. Discharge cell $C_{i,j}$ including scan electrode $SC_i$ and sustain electrode $SU_i$ (i=1 to n), which configure a display electrode pair, and data electrode $D_j$ ($D_j$=$D1_1$ to $D1_k$ and $D2_1$ to $D2_m$) is formed within the discharge space, and the total number of discharge cells $C_{i,j}$ is ((k+m)*n).

In the panel having such a configuration, ultra-violet rays are generated by gas discharge, and the ultra-violet rays excite the phosphor layers of respective colors of R, G, and B to emit visible light for color display.

Figure 3:
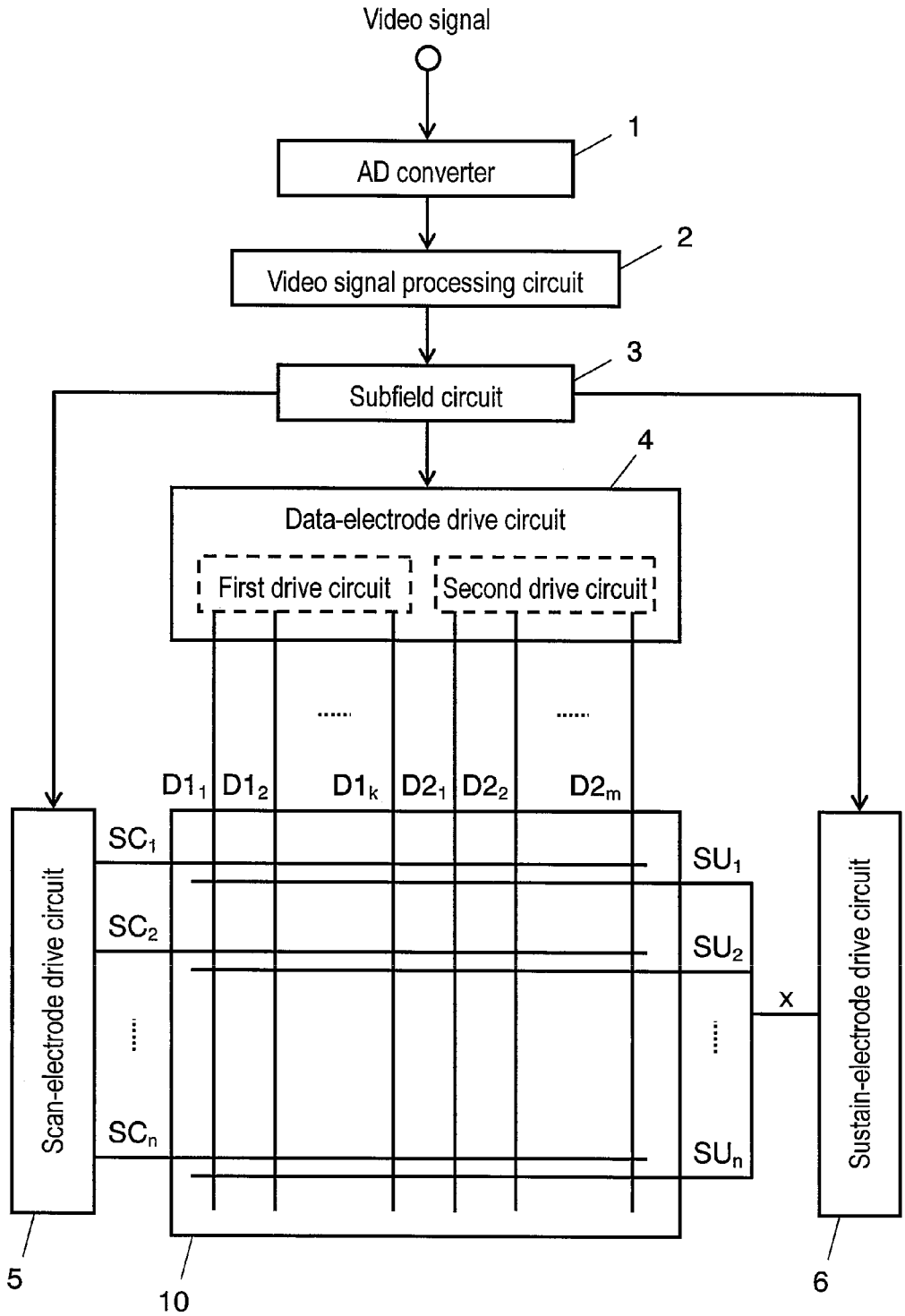
FIG. 3 is a circuit block diagram showing a configuration of the plasma display device of the embodiment 1 of the invention.

FIG. 3 shows a circuit block diagram showing a configuration of the plasma display device of the embodiment 1 of the invention. The plasma display device shown in FIG. 3 has AD converter 1, video signal processing circuit 2, subfield processing circuit 3, data-electrode drive circuit 4, scan-electrode drive circuit 5, sustain-electrode drive circuit 6, and panel 10.

AD converter 1 converts an inputted analog video signal into a digital video signal and outputs the signal. Video signal processing circuit 2 converts an inputted digital video signal into subfield data for controlling each of subfields. Specifically, luminance data corresponding to each of discharge cells $C_{i,j}$ (i=1 to n, j=1 to k and l to m) are extracted from a video signal of one field. Subfield data of discharge cells $C_{i,j}$ are produced in order to correspond to luminance data of discharge cells $C_{i,j}$, the subfield data being for selecting subfields to be turned on from a plurality of subfields having different weight of emission periods. Video signal processing circuit 2 produces subfield data of all discharge cell $C_{i,j}$ in the image display area of panel 10. For emission display of the discharge cells to be turned on among respective discharge cells $C_{i,j}$ in panel 10, subfield processing circuit 3 produces a control signal for the data-electrode drive circuit, a control signal for the scan-electrode drive circuit, and a control signal for the sustain-electrode drive circuit from the subfield data produced by video signal processing circuit 2, and outputs the signals to data-electrode drive circuit 4, scan-electrode drive circuit 5, and sustain-electrode drive circuit 6 respectively.

In panel 10, scan electrodes $SC_1$ to $SC_n$ (scan electrodes 22 in FIG. 1) in n rows and sustain electrodes $SU_1$ to $SU_n$ (sustain electrodes 23 in FIG. 1) in n rows, extending in the row direction, are alternately arranged. Data electrodes $D1_1$ to $D1_k$ and $D2_1$ to $D2_m$ (data electrodes 32 in FIG. 1) in (k+m) columns extending in the column direction are arranged. Discharge cells $C_{i,j}$, each including a pair of scan electrode $SC_i$ and the sustain electrode $SU_i$ (i=1 to n), and one data electrode $D_j$ ($D_j$=$D1_1$ to $D1_k$ and $D2_1$ to $D2_m$), are formed in the number of ((k+m)*n) within the discharge spaces, and three discharge cells emitting light of respective colors of red, green, and blue configure a pixel. Scan electrodes $SC_1$ to $SC_n$, sustain electrodes $SU_1$ to $SU_n$, and data electrode $D_j$ have lead lines for applying drive voltage respectively. Scan-electrode lead lines (not shown) electrically connected to scan electrodes $SC_1$ to $SC_n$ respectively are led out from one side of two sides parallel to data electrode $D_j$ in four sides of panel 10. The scan-electrode lead lines are applied with drive voltage for driving scan electrodes $SC_1$ to $SC_n$ by scan-electrode drive circuit 5 disposed near the side. Sustain-electrode lead lines (not shown) electrically connected to sustain electrodes $SU_1$ to $SU_n$ respectively are led out from the other side of the two sides parallel to data electrode $D_j$ in the four sides of panel 10. The sustain-electrode lead lines are applied with drive voltage for driving sustain electrodes $SU_1$ to $SU_n$ by sustain-electrode drive circuit 6 disposed near the side. Data-electrode lead lines (not shown) electrically connected to data electrodes $D1_1$ to $D1_k$ and $D2_1$ to $D2_m$ respectively are led out from one side of two sides parallel to scan electrode $SC_i$ and sustain electrode $SU_i$ in the four sides of panel 10. The data-electrode lead lines are applied with drive voltage for driving data electrodes $D1_1$ to $D1_k$ and $D2_1$ to $D2_m$ by data-electrode drive circuit 4 disposed near the side.

Data-electrode drive circuit 4 is disposed near the side from which the data-electrode lead lines are led out in the four sides of panel 10. Circuit 4 has a first drive circuit and a second drive circuit within it, the first and second circuits being electrically connected to the data-electrode lead lines and being able to independently drive each of data electrodes $D_j$ according to the control signal for the data-electrode drive circuit. At that time, the first drive circuit drives data electrodes $D1_1$ to $D1_k$ as a data electrode group nearest scan-electrode drive circuit 5, and the second drive circuit drives data electrodes $D2_1$ to $D2_m$ as a data electrode group distant from scan-electrode drive circuit 5. In writing operation, the second drive circuit applies writing pulse voltage to data electrodes $D2_1$ to $D2_m$ after time T has passed since the first drive circuit applied writing pulse voltage to data electrodes $D1_1$ to $D1_k$.

Sustain-electrode drive circuit 6 is disposed near the side from which the sustain-electrode lead lines are led out in the four sides of panel 10. The sustain-electrode drive circuit 6 has a drive circuit within it, the drive circuit being electrically connected to the sustain-electrode lead lines and being able to drive all sustain electrodes $SU_1$ to $SU_n$ collectively according to the control signal for the sustain-electrode drive circuit. Scan-electrode drive circuit 5 is disposed near the side from which the scan-electrode lead lines are led out in the four sides of panel 10. Circuit 5 has a drive circuit within it, the drive circuit being electrically connected to the scan-electrode lead lines and being able to independently drive each of scan electrodes $SC_1$ to $SC_n$ according to the control signal for the scan-electrode drive circuit.

Next, description is made on drive of each of the electrodes.

Figure 4:
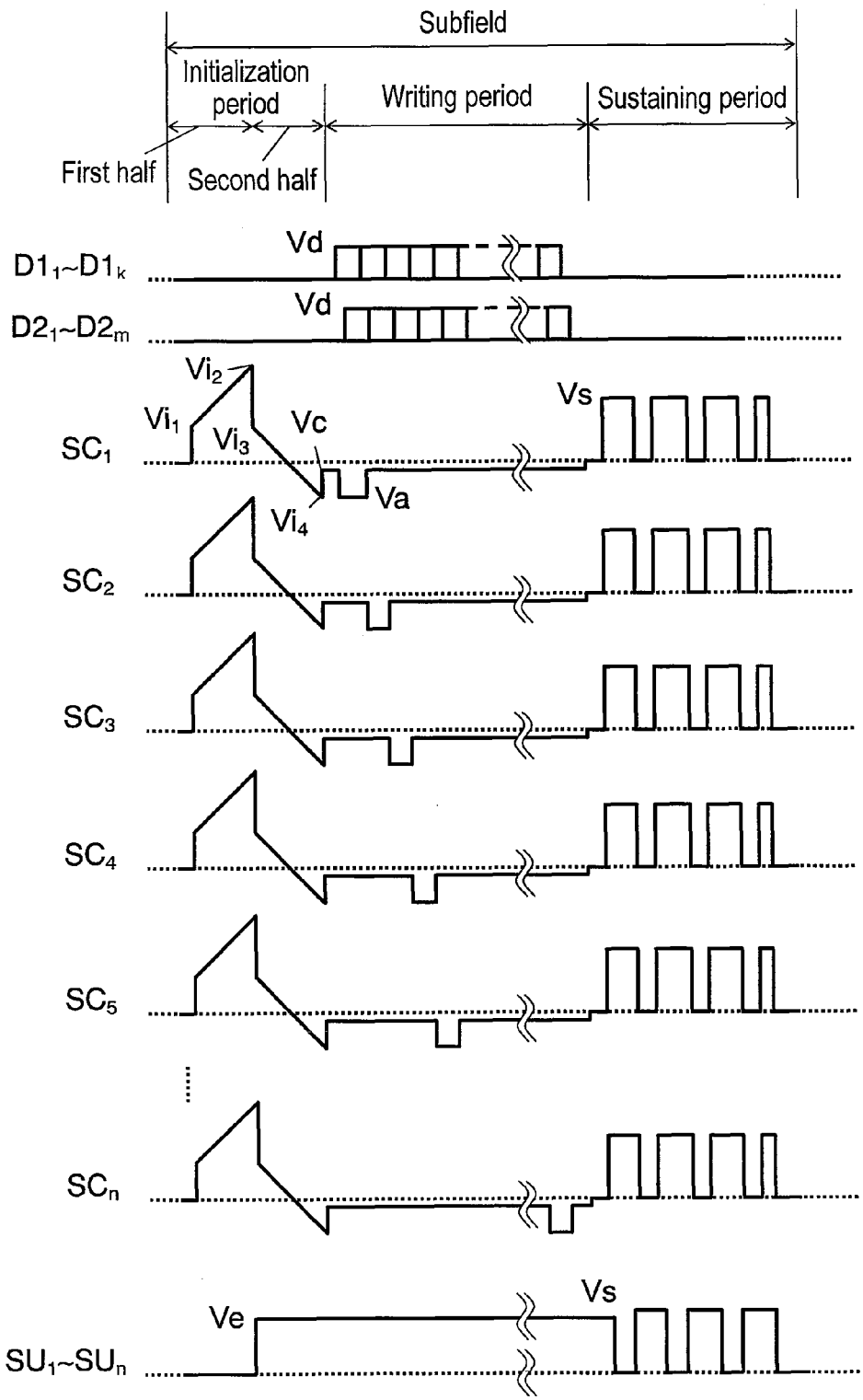
FIG. 4 is a diagram showing drive voltage waveforms to respective electrodes of the plasma display panel of the plasma display device of the embodiment 1 of the invention.

FIG. 4 is a diagram showing drive voltage waveforms to respective electrodes of panel 10 of the plasma display device of the embodiment 1 of the invention. As shown in FIG. 4, each subfield has an initialization period, a writing period, and a sustaining period. In each subfield, approximately the same operation is performed except for the number of sustaining pulses in the sustaining period that is varied to change weight of an emission period, and furthermore operation principle is approximately the same in each of the subfields. Therefore, description is made on operation in only one subfield here.

First, in the first half of the initialization period, data electrodes $D1_1$ to $D1_k$, $D2_1$ to $D2_m$ and sustain electrodes $SU_1$ to $SU_n$ are kept at 0 V respectively, and gradient waveform voltage is applied to scan electrodes $SC_1$ to $SC_n$, the voltage being gradually increased from voltage $Vi_1$ that is equal to discharge start voltage or lower to voltage $Vi_2$ that is more than the discharge start voltage with respect to data electrodes $D1_1$ to $D1_k$, $D2_1$ to $D2_m$. While the gradient waveform voltage is increased, first slight initialization discharge occurs between scan electrodes $SC_1$ to $SC_n$, and sustain electrodes $SU_1$ to $SU_n$ as well as data electrodes $D1_1$ to $D1_k$, $D2_1$ to $D2_m$ respectively. Then, negative wall voltage is accumulated in upper portions of scan electrodes $SC_1$ to $SC_n$, and positive wall voltage is accumulated in upper portions of data electrodes $D1_1$ to $D1_k$, $D2_1$ to $D2_m$ and upper portions of sustain electrodes $SU_1$ to $SU_n$. Here, the wall voltage in upper portions of the electrodes is voltage caused by wall charge accumulated on the dielectric layer covering the electrodes.

In the second half of the initialization period, sustain electrodes $SU_1$ to $SU_n$ are kept at a positive voltage Ve, and gradient waveform voltage is applied to scan electrodes $SC_1$ to $SC_n$, the voltage being gradually decreased from voltage $Vi_3$ that is equal to the discharge start voltage or lower to voltage $Vi_4$ that is more than the discharge start voltage with respect to sustain electrodes $SU_1$ to $SU_n$. During this, second slight initialization discharge occurs between scan electrodes $SC_1$ to $SC_n$, and sustain electrodes $SU_1$ to $SU_n$ as well as data electrodes $D1_1$ to $D1_k$, $D2_1$ to $D2_m$ respectively. Then, the negative wall voltage in the upper portions of scan electrodes $SC_1$ to $SC_n$, and the positive wall voltage in the upper portions of sustain electrodes $SU_1$ to $SU_n$ are reduced, and the positive wall voltage in the upper portions of data electrodes $D1_1$ to $D1_k$, $D2_1$ to $D2_m$ are adjusted to be a value suitable for writing operation. According to the above, initialization operation is finished (hereinafter, drive voltage applied to each of the electrodes is abbreviated as "initialization waveform").

In the writing period, scan electrodes $SC_1$ to $SC_n$, are once kept at voltage Vc. Next, in the writing period of discharge cells $C_{p,1}$ to $C_{p,k+m}$ (p=1 to n), scan pulse voltage Va is applied to scan electrode $SC_p$, and positive writing pulse voltage Vd is applied to data electrode $D_q$ corresponding to a video signal to be displayed in the pth line of data electrodes $D1_1$ to $D1_k$ and $D2_1$ to $D2_m$ ($D_q$ is a data electrode selected for writing according to the video signal in data electrodes $D1_1$ to $D1_k$ and $D2_1$ to $D2_m$). At that time, as described before, between data electrodes $D1_1$ to $D1_k$ and data electrodes $D2_1$ to $D2_m$, time difference is set in timing of applying writing pulse voltage Vd. That is, as shown in FIG. 3, data electrodes $D1_1$ to $D1_k$ as the data electrode group nearest to scan-electrode drive circuit 5 are firstly applied with writing pulse voltage Vd by the first drive circuit. Then, after time T has passed, data electrodes $D2_1$ to $D2_m$ as the data electrode group distant from scan-electrode drive circuit 5 are applied with writing pulse voltage Vd by the second drive circuit. In this way, writing discharge occurs in discharge cell $C_{p,q}$ corresponding to an intersection between data electrode $D_q$ applied with the writing pulse voltage and scan electrode $SC_p$ applied with the scan pulse voltage. The writing discharge causes accumulation of positive voltage in an upper portion of scan electrode $SC_p$ of discharge cell $C_{p,q}$, and accumulation of negative voltage in an upper portion of sustain electrode $SU_p$, and consequently the writing operation is finished. After that, similar writing operation is performed for each of discharge cells to discharge cell $C_{n,q}$ in the nth line, and the writing operation is finished. The reason why the writing pulse voltage is first applied to the data electrode group nearest to scan-electrode drive circuit 5, and then applied to the data electrode group distant from scan-electrode drive circuit 5 is described later.

In the sustaining period, scan electrodes $SC_1$ to $SC_n$ are once returned to 0 V, then positive sustaining pulse voltage Vs is applied to scan electrodes $SC_1$ to $SC_n$, and then sustain electrodes $SU_1$ to $SU_n$ are returned to 0 V. At that time, voltage between the upper portion of scan electrode $SC_p$ and the upper portion of sustain electrode SUP in discharge cell $C_{p,q}$, in which the writing discharge occurred, becomes larger than the discharge start voltage because the wall voltage accumulated in the upper portion of scan electrode $SC_p$ and the upper portion of sustain electrode $SU_p$ during the writing period is added to positive sustaining pulse voltage Vs. As a result, first sustaining discharge occurs. After the first sustaining discharge, positive sustaining pulse voltage Vs is applied to sustain electrodes $SU_n$ to $SU_n$, then scan electrodes $SC_1$ to $SC_n$ are returned to 0 V. At that time, voltage between the upper portion of scan electrode $SC_p$ and the upper portion of sustain electrode SUP in discharge cell $C_p$, q, in which the writing discharge occurred, becomes larger than the discharge start voltage because the wall voltage accumulated in the upper portion of scan electrode $SC_p$ and the upper portion of sustain electrode $SU_p$ during the writing period is added to positive sustaining pulse voltage Vs. As a result, second sustaining discharge occurs. After that, similarly, the sustaining pulse is alternately applied to scan electrodes $SC_1$ to $SU_n$ and sustain electrodes $SU_1$ to $SU_n$, thereby the sustaining discharge continuously occurs in discharge cell $C_p$, q in which the writing discharge occurred by the number of the sustaining pulse.

Hereinbefore, description has been made on the electrode arrangement of panel 10, and the drive voltage waveforms for driving panel 10 and the timing of the waveforms.

Next, the reason why the writing pulse voltage is first applied to data electrodes $D1_1$ to $D1_k$ as the data electrode group nearest scan-electrode drive circuit 5, and then applied the voltage to data electrodes $D2_1$ to $D2_m$ as the data electrode group distant from scan-electrode drive circuit 5 is described.

Figure 5A:
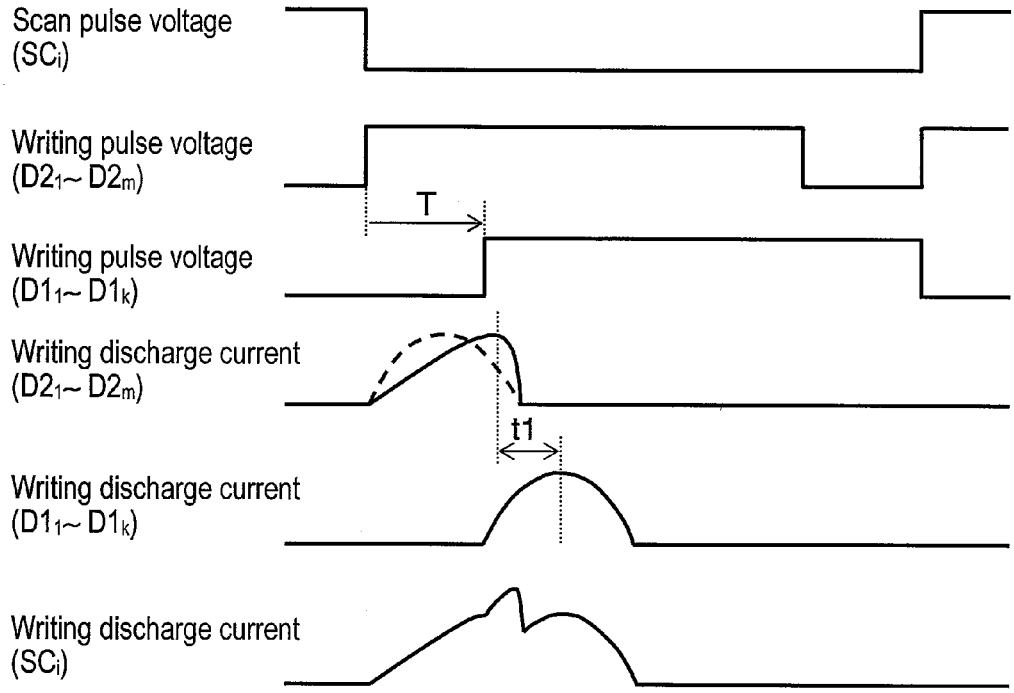
FIG. 5A is an enlarged diagram of drive voltage waveforms and current waveforms of a scan electrode and a data electrode in a writing period of the plasma display panel in the case that writing pulse voltage is applied first to a data electrode group distant from a scan-electrode drive circuit of the plasma display device of the embodiment 1 of the invention.
Figure 5B:
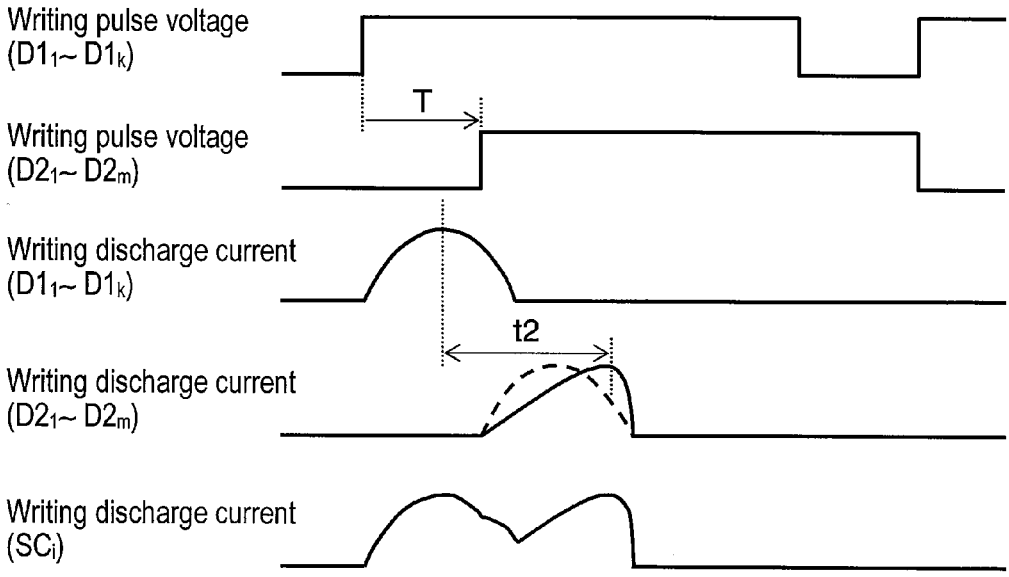
FIG. 5B is an enlarged diagram of drive voltage waveforms and current waveforms of the scan electrode and the data electrode in the writing period of the plasma display panel in the case that the writing pulse voltage is applied first to a data electrode group nearest to the scan-electrode drive circuit of the plasma display device of the embodiment 1 of the invention.

FIG. 5A and FIG. 5B are enlarged diagrams of drive voltage waveforms and current waveforms of scan electrodes $SC_1$ to $SC_n$ and data electrodes $D1_1$ to $D1_k$ and $D2_1$ to $D2_m$ in the writing period of the plasma display panel of the embodiment 1 of the invention. FIG. 5A shows the voltage waveforms and writing discharge current waveforms in the case that writing pulse voltage is applied first to data electrodes $D2_1$ to $D2_m$ as the data electrode group distant from the scan-electrode drive circuit 5. FIG. 5B shows the writing pulse voltage waveforms and writing discharge current waveforms in the case that the writing pulse voltage is applied first to data electrodes $D1_1$ to $D1_k$ as the data electrode group nearest to scan-electrode drive circuit 5.

First, FIG. 5A shows the writing voltage waveforms and the writing discharge current waveforms in the case that the writing pulse voltage is applied first to data electrodes $D2_1$ to $D2_m$ as the data electrode group distant from scan-electrode drive circuit 5, and then after time T has passed, the writing pulse voltage is applied to data electrodes $D1_1$ to $D1_k$ as the data electrode group nearest to scan-electrode drive circuit 5.

Data electrodes $D1_j$ in the number of (k+m) intersect with one scan electrode $SC_i$ with the discharge spaces between them as described before. Therefore, there are (k+m) discharge cells intersecting with data electrodes $D_j$ on one scan electrode $SC_i$. Moreover, since scan electrode $SC_i$ is applied with the scan pulse voltage from scan-electrode drive circuit 5 connected to one end of scan electrode $SC_i$, distances from scan-electrode drive circuit 5 to respective intersecting discharge cells are different. Therefore, impedance from scan-electrode drive circuit 5 to the respective intersecting discharge cells on scan electrode $SC_i$ increases in an intersecting discharge cell more distant from scan-electrode drive circuit 5 due to parasitic capacitance generated between scan electrode $SC_i$ and other electrodes, or internal resistance or inductance of metal lines themselves forming scan electrode $SC_i$. That is, voltage drop due to discharge current generated during writing discharge tends to increase in the discharge cell more distant from scan-electrode drive circuit 5. When the voltage drop due to discharge current increases, voltage applied to the discharge cells is decreased, causing unstable discharge, in addition, increase in delay in discharge.

From such a reason, in data electrodes $D2_1$ to $D2_m$ as the data electrode group distant from scan-electrode drive circuit 5, writing discharge may occur with a certain delay compared with ideal discharge (shown by a broken line) without voltage drop, at a high possibility, as shown in writing discharge current ($D2_1$ to $D2_m$) in FIG. 5.

On the other hand, in writing discharge in data electrodes $D1_1$ to $D1_k$ as the data electrode group nearest scan-electrode drive circuit 5, the impedance from scan-electrode drive circuit 5 to the respective intersecting discharge cells on scan electrode $SC_i$ is small compared with the case of data electrodes $D2_1$ to $D2_m$. Therefore, the voltage drop due to the discharge current during writing discharge can be controlled low, and therefore large delay in discharge occurs at a low possibility.

Accordingly, when writing pulse voltage is applied first to data electrodes $D2_1$ to $D2_m$ as the data electrode group distant from scan-electrode drive circuit 5, and then applied to data electrodes $D1_1$ to $D1_k$ as the data electrode group nearest scan-electrode drive circuit 5, delay in discharge during writing discharge in data electrodes $D2_1$ to $D2_m$ tends to increase compared with delay in discharge during writing discharge in data electrodes $D1_1$ to $D1_k$. Therefore, time difference t1 between peak values of the writing discharge current generated in the respective data electrode groups may be smaller than time difference T between the two data electrode groups when the writing pulse voltage is applied, at a high possibility. That is, unless the time difference T when the writing pulse voltage is applied to the two data electrode groups is set sufficiently large, the two peaks of the writing discharge current hardly appears in a sufficiently separated manner. In that case, discharge current flowing into scan electrode $SC_i$ is also not dispersed, as a result, the peak value of the current becomes large as shown in writing discharge current ($SC_i$) in FIG. 5A. When the peak value of the discharge current flowing into scan electrode $SC_i$ becomes large, a difficulty arises, that is, the electrodes sometimes can not be driven because the current exceeds driving capacity of scan-electrode drive circuit 5, or voltage drop occurring on scan electrode $SC_i$ due to output impedance of scan-electrode drive circuit 5 is further increased. As a result, the writing discharge becomes further unstable. Such a phenomenon is particularly significant in the case that the data electrodes are driven using a data-electrode drive circuit with a data driver IC in a power collection type using LC resonance, for example, as shown in FIG. 12 of Japanese Patent Unexamined Publication No. 2004-212699.

Thus, as shown in FIG. 5B, the embodiment 1 of the invention is configured in a way that the writing pulse voltage is applied first to data electrodes $D1_1$ to $D1_k$ as the data electrode group nearest to scan-electrode drive circuit 5 by the first drive circuit, then it is applied to data electrodes $D2_1$ to $D2_m$ as the data electrode group distant from scan-electrode drive circuit 5 with delay by time T by the second drive circuit. In this way, writing discharge is induced first in data electrodes $D1_1$ to $D1_k$ having comparatively small delay in discharge, then writing discharge is induced in data electrodes $D2_1$ to $D2_m$ in which the delay in discharge tends to be large. According to this, time difference t2 between peak values of the writing discharge current generated in the respective data electrode groups can be made larger than time difference T between the two data electrode groups when the writing pulse voltage is applied.

That is, in such a configuration, even if the time difference when the writing pulse voltage is applied to the two data electrode groups is set small compared with the case that the writing pulse voltage is applied first to the data electrode group distant from the scan-electrode drive circuit 5, the writing discharge can be induced in the sufficiently separated manner. Therefore, the writing discharge current flowing into scan electrode $SC_i$ can be sufficiently dispersed. Accordingly, as shown in writing discharge current ($SC_i$) in FIG. 5B, the peak value of current can be decreased, and load applied on scan-electrode drive circuit 5 can be decreased. Consequently voltage drop occurring on scan electrode $SC_i$ can be reduced. In this way, the writing discharge can be stably induced.

As described hereinbefore, the embodiment of the invention is configured in a way that when the data electrodes are divided into at least two data electrode groups and driven, the writing pulse voltage is applied first to the data electrode group nearest the scan-electrode drive circuit, and then applied to the data electrode group distant from the scan-electrode drive circuit. As a result, time difference in peak value of writing discharge current becomes larger than time difference in timing of applying the writing pulse voltage to the respective data electrode groups. Therefore, even if the time difference in timing of applying the writing pulse voltage to the respective data electrode groups is reduced, writing discharge can be induced in a surely separated manner, and the peak value of the discharge current flowing into the scan electrodes in discharge during the writing period can be sufficiently controlled low so that voltage is stably applied to respective discharge cells, consequently a plasma display device that realizes stable writing discharge can be provided.

From the above reason, the advantages according to the embodiment of the invention is particularly significant in the case of using the data-electrode drive circuit with the data driver IC in the power collection type using the LC resonance for driving the electrodes.

While a configuration where the data electrodes are divided into two data electrode groups in the data electrode number of k and m respectively and driven was described in the embodiment of the invention, the configuration is merely shown as an example of the embodiment, and is not restrictive. For example, the number of the data electrodes included in each of the data electrode groups may be set to be the same number. Moreover, a configuration of providing three or more of data electrode groups may be used. In any case, since these values have different optimum values depending on various design items such as properties of the panel or properties of respective drive circuits, it is desirable that experiments are carried out in accordance with respective design conditions to appropriately set the values to be the optimum values. When three or more of data electrode groups are provided, a configuration is used, in which the writing pulse voltage is applied at a predetermined time interval in order from a data electrode group nearest to the scan-electrode drive circuit.

INDUSTRIAL APPLICABILITY

In the plasma display device according to the invention, when data electrodes are divided into a plurality of data electrode groups and driven, even if time difference in timing of applying writing pulse voltage to the respective data electrode groups is reduced, writing discharge can be induced in a securely separated manner, and a peak value of discharge current flowing into scan electrodes in discharge during a writing period is sufficiently controlled low so that voltage is applied stably to respective discharge cells, consequently stable writing discharge can be realized, which is useful for the plasma display device.

The invention claimed is:

1. A plasma display device comprising:

a plasma display panel having a plurality of scan electrodes and sustain electrodes, which are disposed parallel to each other on a front panel and configure display electrode pairs, and are electrically connected to a plurality of scan-electrode lead lines and sustain-electrode lead lines at one ends respectively, and a plurality of data electrodes that are disposed in a direction intersecting with the scan electrodes on a back panel disposed oppositely to the front panel with discharge spaces between them, and configure display cells with the display electrode pairs;

a scan-electrode drive circuit connected to the scan-electrode lead lines for driving the scan electrodes;

a sustain-electrode drive circuit connected to the sustain-electrode drive circuit for driving the sustain electrodes; and a data-electrode drive circuit that divides the data electrodes into a plurality of data electrode groups and drives the groups respectively;

wherein the data-electrode drive circuit applies writing pulse voltage to each of the data electrode groups in order from a data electrode group nearest to the scan-electrode lead lines in a writing period; and wherein in the writing period, time between adjacent two peaks of writing discharge current flowing into the data-electrode drive circuit by applying the writing pulse voltage to each of the data electrode groups is longer than time from applying writing pulse voltage to the data electrode group nearest to the scan-electrode drive circuit to applying the writing pulse voltage to a data electrode group second-nearest to the scan-electrode drive circuit.

2. A plasma display device comprising:

a plasma display panel having a plurality of scan electrodes and sustain electrodes, which are disposed parallel to each other on a front panel and configure display electrode pairs, and a plurality of data electrodes that are disposed in a direction intersecting with the scan electrodes on a back panel disposed oppositely to the front panel with discharge spaces between them, and configure display cells with the display electrode pairs;

a scan-electrode drive circuit that is disposed close to one side among two sides parallel to the data electrodes in four sides of the plasma display panel, and drives the scan electrodes;

a sustain-electrode drive circuit that is disposed close to the other side among the two sides parallel to the data electrodes in the four sides of the plasma display panel, and drives the sustain electrodes; and a data-electrode drive circuit that is disposed close to one side among two sides parallel to the scan electrodes and the sustain electrodes in the four sides of the plasma display panel, and divides the data electrodes into a plurality of data electrode groups and drives the groups respectively;

wherein the scan-electrode drive circuit, the sustain-electrode drive circuit, and the data-electrode drive circuit apply different driving waveforms to each of the scan electrodes, the sustain electrodes, and the data electrodes in the writing period and the sustaining period to drive the electrodes, the two periods configuring a subfield, and the data-electrode drive circuit applies writing pulse voltage to each of the data electrode groups in order from a data electrode group nearest to the scan-electrode drive circuit in the writing period;

wherein in the writing period, time between adjacent two peaks of writing discharge current flowing into the data-electrode drive circuit by applying the writing pulse voltage to each of the data electrode groups is longer than time from applying writing pulse voltage to the data electrode group nearest to the scan-electrode drive circuit to applying the writing pulse voltage to a data electrode group second-nearest to the scan-electrode drive circuit.

3. The plasma display device of claim 1:

wherein the data-electrode drive circuit uses a data-electrode drive circuit in a power collection type using LC resonance.

4. The plasma display device of claim 2 wherein the data-electrode drive circuit uses a data-electrode drive circuit in a power collection type using LC resonance.

* * * * *